United States Patent [19]

Davydov et al.

[11] 4,189,930

[45] Feb. 26, 1980

[54] METHOD OF OBTAINING REFRIGERATION AT CRYOGENIC LEVEL

[76] Inventors: Anatoly B. Davydov, ulitsa Udaltsova, 14, kv. 147; Sergei M. Korsakov-Bogatkov, 5 Parkovaya ulitsa, 56/6, kv. 74; Boris D. Krakovsky, Narodnaya ulitsa, 13, kv. 136; Vasily D. Nikitkin, Tsvetnoi bulvar, 25, kv. 95; Evgeny V. Onosovsky, ulitsa Z. i A. Kosmodemyanskikh, 8/7, kv. 131; Vladimir G. Pronko, B. Kozlovsky pereulok, 11, kv. 42; Leonid M. Stopler, Krasnobogatyrskaya ulitsa, 21, kv. 136; Boris A. Chernyshev, Smolenskaya naberezhnaya 2, kv. 16; Boris A. Antipenkov, 1 Truzhenikov pereulok, 13, kv. 6, all of Moscow, U.S.S.R.

[21] Appl. No.: 807,745

[22] Filed: Jun. 17, 1977

[51] Int. Cl.[2] ..... F25B 1/00

[52] U.S. Cl. ..... 62/502; 62/513; 62/514 R

[58] Field of Search ..... 62/514 R, 502, 513

[56] References Cited

U.S. PATENT DOCUMENTS 3,613,387 10/1971 Collins ..... 62/100

OTHER PUBLICATIONS

Katheder, H. et al.: Long Term Experience with the Liquifying Stage & a 4.4K Cooling Cycle of a 300 W Refrigerator, Fifth International Cryogenic Engineering Conference.

*Primary Examiner*—Ronald C. Capossela
*Attorney, Agent, or Firm*—Haseltine, Lake & Waters

[57] ABSTRACT

A method of obtaining refrigeration at a cryogenic level comprising a gaseous fluid fed in the form of an incoming stream to sustain a refrigerative load. The incoming stream is stepwise cooled and expanded with liquefaction. The liquid fluid formed is used to sustain a refrigerative load, evaporating as a consequence, and the vapour constitutes a return stream which is adiabatically compressed so as to attain a temperature close to the temperature of the incoming stream before the liquefaction thereof.

5 Claims, 7 Drawing Figures

METHOD OF OBTAINING REFRIGERATION AT CRYOGENIC LEVEL

FIELD OF THE INVENTION

The present invention relates to cryogenic engineering, and more specifically to a method of obtaining refrigeration at cryogenic level.

The present invention can be used to advantage in obtaining refrigeration at the level of the boiling point of the fluid circulating in a cryogenic system, especially when the fluid used is a lightweight gas, e.g., helium or hydrogen.

The invention may also find utility in equipment for the liquefaction and shipment of natural gas, in air separation plants and in other fields where cold temperature is either produced or used, such as research tools of the physicist, power generation, nuclear and electrical engineering, biology, etc.

BACKGROUND

What is witnessed today is not only an ever-increasing demand for systems producing cold temperatures at cryogenic level but improved performance and good economy of these systems, including their refrigerating capacity, power requirements, operational dependability and some other factors. The high demand seems to be quite natural in the light of the rapid progress made in the field of scientific and applied research work dealing with superconductivity such as the development of electrical machinery, powerful magnets, power transmission lines, electronic devices; the use of liquid hydrogen on a large scale is another source of this demand. Since the equipment employing the phenomenon of superconductivity is bound to operate at temperature as low as 1.5° to 15° K., the power requirements of a cryogenic system used to maintain such temperature can run into hundreds and thousands of kilowatts if the plant cooled is a big one. This all calls for giving top priority to the problem of reducing the amount of energy consumed in producing cold temperature and of improving cryogenic systems so as to increase their operational dependability, reduce weight and size, etc. Not infrequent are such cases when there is a need to lower the level of the cold temperature produced maintaining the economy of the process at a high level at the same time.

What is called actual power requirements in producing cold temperature are given as the ratio of energy consumed, mainly in driving the compressor, to the unit energy removed by the refrigerant in terms of the refrigerating capacity. Since both these values are commonly given in watts, the actual power requirements are expressed by a dimensionless figure (W/W). For those who are versed in cryogenics, the term refrigerating capacity denotes the amount of heat removed by a system per unit time at the temperature level specified.

There is known a method of producing cold temperature involving a number of operations described hereinafter in describing by way of example a helium cryogenic system capable of producing ultra-low temperature at the level of the boiling point of liquid helium, i.e., between 4.2° and 4.5° K.

Gaseous helium is compressed to a pressure of 20–30 bars, using a compressor. The compressed helium constitutes an incoming stream heading toward a refrigerative load, and this incoming stream is cooled to approximately 100° K. by a return stream of helium flowing back from the refrigerative load under a low pressure. After that, the incoming stream in split into two streams of which one is a main stream and the other is a subsidiary stream. This latter stream is expanded in expanders, some external work being done, and is used to compensate for irreversible losses and to cool the main stream in a stepwise manner, the number of cooling stages being determined by the number of expanders used in expanding the subsidiary stream. A bath with a liquid refrigerant, for example, nitrogen or any other substance whose boiling point is sufficiently low to make for the process of cooling is used sometimes instead of the expanders. The main stream, on passing through all the cooling stages, is admitted into a liquefaction stage wherein it is given additional cooling and expanded with liquefaction. The liquid helium formed is used to sustain a refrigerative load and, on absorbing heat therefrom, evaporates. The vapour constitutes a return stream fed back into the liquefaction stage at a temperature of 4.3° to 4.5° K. in a countercurrent flow to the main and subsidiary streams, is warmed up in the heat exchangers of all stages, merged underway with the subsidiary stream expanded in the expanders and admitted into the compressor under the atmospheric pressure and at a temperature of 300° K. for compression. This completes the cycle which is then repeated.

In one version of the method described, the process of expanding the main stream with its liquefaction in the liquefaction stage is accomplished by throttling and in another version the same goal is attained by expansion accompanied by external work. Throttling is practiced for many years, and the process of expansion into the region of saturated vapour accompanied by external work is described in "Cryogenic Engineering" by R. B. Scott, D. Van Nostrand Co. Inc., Princeton, 1959. Considering by way of example the operation of a helium cryogenic system, the author points out the advantages of said process of expansion when this process is being compared with the process of throttling.

In the method of obtaining refrigeration which is now under consideration, the energy consumed in compressing gas is removed not only in order to produce supercold temperature but also serves to compensate for various losses, being consequently dissipated without any useful effect and increasing the entropy of helium. These losses are termed as those due to the irreversibility of the process and they are incurred owing to heat transfer at temperature gradients other than zero, to friction opposing the flow of helium and due to some other factors.

Thermodynamically justified are less than 20% of the energy consumed in cryogenic systems, the balance being wasted in compensating for irreversible losses, the bulk whereof is incurred due to a difference in temperature, particularly in the region of ultra-low temperatures. Calculations reveal that the losses incurred in the last cooling stage of the liquefaction stage are approximately at balance with the net effect, i.e., refrigerating capacity, and any reduction of these losses is conducive to an increase in the efficiency of the method of obtaining refrigeration or in the performance of the system employing same. The effect of the losses of energy due to the irreversibility of the process of, say, heat exchange is that transferred to the incoming stream is only a fraction of the refrigeration the return stream is capable of, the rest being wasted in the course of incomplete heat exchange resulting in an increase of the entropy of helium. The consequence is that less liquid fluid fed to sustain the refrigerative load is formed from the incoming stream, implying that the refrigerating capacity of the system is not as high as this is desirable. On the other hand, an effort to obtain a sufficient amount of liquid fluid without reducing the losses of energy due to irreversibility calls for increasing the amount of energy consumed because more gas should be compressed in the compressor. The losses due to the irreversibility of the process of heat exchange increase with the ratio of the difference in temperatures to the absolute temperature.

Substantial losses due to the irreversibility of the process of heat exchange are incurred in the liquefaction stage even then when the main stream is expanded with liquefaction and external work being done at the same time. Said disadvantage, pointed out in the above work by R. B. Scott, is inherent due to a considerable difference between the temperatures of the incoming and return streams in the liquefaction stage even in a theoretically idealized case, this difference being especially pronounced in the region of the lowermost temperature of the streams and inviting an increase in entropy. The efficiency of the heat exchanger has no bearing on said difference of temperatures which will be present in a theoretically idealized case, i.e., one when the difference between the temperatures of the streams at the cold end of the heat exchanger is equal to zero. When used as the fluid is helium, the difference between the temperatures of the incoming stream, or the main stream as in the case under consideration, and the return stream is around 1.5° K. at the warm end of the heat exchanger in the liquefaction stage, provided the pressure of the incoming stream is 25 bars and that of the return one is 1.3 bar and the temperature of this return stream is 4.5° K. Said temperature difference increases to 2.5° K. toward the medial part of the heat exchanger and then gradually decreases to under 0.5° K. at the cold end of the heat exchanger. The temperature difference of under 0.5° K. is to be regarded as the maximum allowable one among those temperature differences which are compatible with high efficiency of obtaining refrigeration. The direct effect of this diadvantage is an inefficient use of the refrigeration the return stream is capable of over the range of temperatures between the boiling points which is 4.5° K. for helium and the temperature of the compressed stream before its expansion with liquefaction which is around 6° K. for helium. This fact either reduces the refrigerating capacity or increases the amount of energy consumed. If in realizing the known method a specified refrigerating capacity is to be attained, the only answer is to increase the amount of gas compressed which entails a high consumption of energy.

Recent years saw a method of obtaining refrigeration at a cryogenic level between 1.8° and 4.0° K. coming into wide-spread use because, as the research work carried out in vatious countries has proved it, in certain fields as, of example, radio engineering and nucleonics the lowering of the level of the refrigeration obtained by as little as 0.5° K. leads to qualitively new results. Yet, difficulties are encountered in employing cryogenic systems operating at temperature levels below the boiling point of helium under the atmospheric pressure and these difficulties are the soaring costs whenever an attempt is made to obtain a more deeper refrigeration.

Known in the art is a method of obtaining refrigeration at a temperature under 4.0° K. and, in particular, one at the level of 1.8° K. (cf. Ketheder H., Lehmann W., Spath F., "Long-term experience with the liquefying stage and a 4.4° K.-cooling cycle of a 300 W-refrigerator", Proceedings of the Fifth International Cryogenic Engineering Conference, p. 546, Kyoto, 1974, IPC Business Press Ltd., London, 1974) wherein helium is compressed to a pressure of around 20 bars at ambient temperature. The incoming stream of compressed helium so formed is fed to sustain a refrigerative load on being cooled in a stepwise manner by a return stream of the same gaseous fluid flowing back from the refrigerative load in the reverse direction. The cooling of the incoming stream takes place in successively arranged cooling stages by analogy with the method described above.

The fundamental difference of this method compared with the one described hereinabove consists in that the stream of compressed gas is being expanded in the liquefaction stage with its simultaneous liquefaction to a pressure which is below the atmospheric and depends on the level of refrigeration required to obtain. So, if a temperature at a level of 1.8° to 2.0° K. is required, the gas is expanded to a pressure between 12 and 20 mm Hg. Under the same pressure progressing back for the refrigerative load is the vapour of helium constituting the return stream which, on passing through all the cooling stages in the reverse direction, warms up to a temperature close to the ambient and is admitted into a vacuum pump wherein it is compressed to the atmospheric pressure. The outflow from the vacuum pump is fed into the compressor. To be exact, the pressure upstream of the vacuum pump is less than the pressure expanded whereto has been the gas, i.e., anywhere between 12 and 20 mm Hg, owing to the resistance of the heat exchangers to the flow of the return stream.

Should a need arise to feed liquid helium for sustaining a refrigerative load under a pressure in excess of 1 bar and at a temperature below 4.0° K., it can be met by providing an intermediate refrigerative load. Serving as such in this case can the main stream itself which has been expanded in the liquefaction stage to a pressure sustained whereat is the refrigerative load and which needs further cooling. This cooling is effected by way of heat exchange between the main stream and that portion of this stream which has been expanded and is boiling under vacuum.

Since the bulk of the fluid in circulation is subject to additional compression in the vacuum pump, the power requirements this method calls for rise very sharply. For all its ability to offer refrigeration at a level below 4.0° K. and even as low as 1.8° K., this method displays a number of other disadvantages along with high power requirements. Among the disadvantages is the need in intricate and costly equipment, such as vacuum pumps. The heat exchangers used in conjunction with a system realizing this method are, in their turn, bulky and of intricate construction due to the fact that the vapour of helium returns from the refrigerative load under a pressure by far lower than the atmospheric.

SUMMARY OF THE INVENTION

It is an object of the present invention to eliminate the above disadvantages.

The main object of the present invention is to provide a method of obtaining refrigeration at cryogenic level whereby the losses of energy incurred in the liquefaction stage of the cryogenic system due to the irreversibility of the process of heat exchange between the return and incoming streams are at their minimum.

Another object of the present invention which is of no less importance then the foregoing one is to provide a method of obtaining refrigeration at a temperature level under 4.0° K. wherein no vacuum pumps are needed upstream of the compressor or, if vacuum pumps are used, their compression ratio is substantially reduced.

A further object of the present invention is to provide a method of obtaining refrigeration without the recourse to all those intricate and costly heat exchangers handling streams under a pressure as low as 1/10 of the atmospheric or even lower.

Said objects are attained by the fact that in a method of obtaining refrigeration at cryogenic level consisting in that a gaseous fluid fed in the form of an incoming stream to sustain a refrigerative load is compressed, stepwise cooled and expanded with liquefaction and the liquid fluid so formed is used to sustain at least one refrigerative load, evaporating as a consequence, and the vapour forms a return stream flowing back from the refrigerative load, the return stream flowing back from at least one refrigerative load is, in accordance with the invention, adiabatically compressed so as to attain a temperature close to the temperature of the incoming stream before the expansion thereof with liquefaction.

It will be noted that in realizing the method disclosed by expanding the incoming stream with some external work being done followed by its liquefaction and by compressing the vapours adiabatically to a temperature of the incoming stream before its expansion under idealized conditions, i.e., those when no losses are incurred, the cycle follows in fact the pattern of the Carnot cycle. For an expert versed in cryogenics, the Carnot cycle is a theoretically reversible cycle accomplished with a minimum loss of energy. This implies that in the method disclosed the cycle approximates under real conditions the reversible cycle very closely and is accomplished with the losses due to irreversibility being at their minimum.

By changing the pressure to which the incoming stream is expanded, refrigeration at various temperature levels is obtainable. For compressing the return stream, a compressor can be used operating at the temperature of liquid helium, said compressor being referred to hereinafter as the cold compressor.

Since in most case the temperature of the fluid bed to sustain one of the refrigerative loads must be below the boiling point of this fluid, being decided by the pressure specified for used in the refrigerative load sustained, a further cooling upstream of the refrigerative load sustained is effected in accordance with the method disclosed by way of heat exchange taking place between a liquefied main stream and another stream split therefrom and boiling under a reduced pressure corresponding to the temperature cooled thereto should be the main stream while the vapour of fluid formed in consequence is adiabatically compressed, constituting the return stream. In all cases of carrying the method disclosed into practice, the losses of energy are reduced by a good deal not only because in the cycle described the losses due to irreversibility are at their minimum but also the amount of energy consumed in compressing a stream under vacuum and at low temperature is by far smaller than the amount required to compress the fluid in a vacuum pump at ambient temperature. Inasmuch as in the method disclosed the pressure of the vapour of helium admitted into the heat exchangers on leaving the refrigerative load sustained is always lower than in the known methods, these heat exchangers can be provided in a very compact form and of simple construction.

It is expedient that the return stream is warmed up in the liquefaction stage by the expanded incoming stream before being adiabatically compressed. This is conducive to obtaining a more deeper refrigeration and to simplifying, in some instances, the construction of the expander, in which helium is expanded, as well as to improving the conditions under which the cold compressor is required to operate.

It is also expedient, when at least two successively arranged refrigerative loads are to be sustained circulating through each of which is a separate stream of gaseous fluid, that the return stream from a preceeding refrigerative load is subject, before being adiabatically compressed, to a heat exchange with the return stream from a succeding refrigerative load after the adiabatic compression thereof. This feature enables the separate stream of gaseous fluid circulating between the preceding and succeeding refrigerative loads to bring refrigeration down to a lower temperature level without reducing the pressure of the return stream outflowing from the preceeding refrigerative load and at minimum losses of energy. Actually, the return stream outflowing from the succeeding refrigerative load is compressed in the cold compressor, cooled in the preceeding refrigerative load—being thus converted into the incoming stream intended to sustain the succeeding refrigerating load—and then the incoming stream is expanded with liquefaction, vapourized in sustaining the succeeding refrigerative load and the return stream so formed is compressed in the cold compressor. The absence of vacuum stream in the cooling stages allows to reduce the size of the heat exchangers and to simplify the construction thereof. Kept under vacuum is only one refrigerative load which is being cooled by the subsidiary stream, and this advantage is particularly noticeable in obtaining refrigeration at a level between 1.8° and 3.5° K.

The method disclosed compares favourably also in those cases when the succeeding refrigerative load is sustained at a temperature level lower than that sustained whereat is the preceeding refrigerative load and may consequently become a source of contamination of the fluid with air. The facilities for the purification of helium which must be provided in the cryogenic system in these cases need not be too bulky, for just a fraction of the circulating gas is passed therethrough.

It is further expedient that the return stream outflowing from the succeeding refrigerative load is warmed up by the incoming stream of the gaseous fluid before being adiabatically compressed. This feature is conductive to lowering the level of refrigeration at a low ratio of compression of the return stream outflowing from the preceeding refrigerative load sustained and to improving the conditions under which the cold compressor and expander are operating.

It is yet also expedient that used as the gaseous fluid constituting the stream outflowing from the succeeding refrigerative load is helium-3, an isotope of helium. This feature also enables a greater refrigeration to be obtained and a thrifty one, for helium-3 which is a costly isotope used only in the low-temperature part of the system.

The effect of carrying the disclosed method of obtaining refrigeration at cryogenic level into practice is a reduction of the power requirements for producing refrigeration which is a factor of paramount importance in the systems yielding refrigeration at a temperature level under 4° K.

Another point to be noted is that, compared with the known methods, the method disclosed simplifies the construction of cryogenic system employing helium, improves the conditions under which the means of compressing helium operate and reduces the cost of cryogenic systems which are known to be expensive.

A further point is that the method disclosed eliminates strict dependence of the pressure of fluid at the inlet into the compressor on the temperature level of the refrigeration obtained. This, in its turn, allows to reduction of the size of the compressor and to improve its operating conditions.

A special point is that the possibility of the ingress of air through movable seals of the compressor resulting in the contamination of fluid is reduced to a minimum in the method disclosed.

BRIEF DESCRIPTION OF THE DRAWINGS

Said features and other advantages of the invention will be best understood from the following description of the preferred embodiments of the invention when this description is being read in conjunction with the accompanying drawings in which.

DETAILED DESCRIPTION

The disclosed method of obtaining refrigeration at cryogenic level in accordance with the present invention is carried into practice in the following way.

Figure 1:
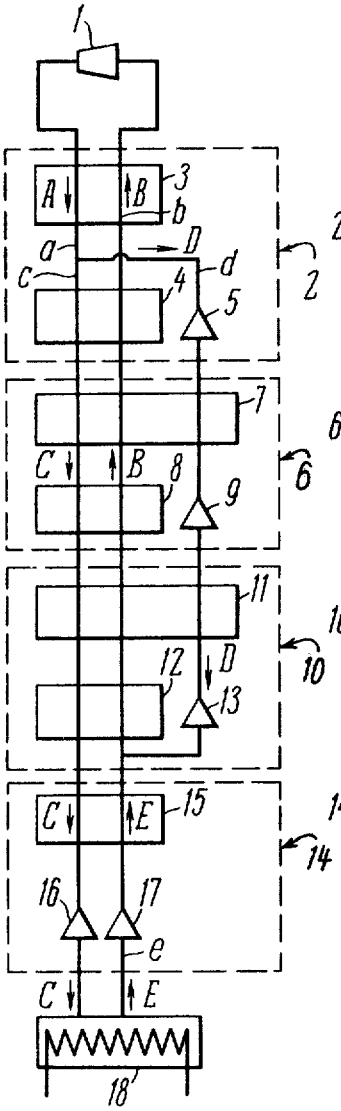
FIG. 1 is a schematic diagram of a cryogenic system serving to carry into practice the method according to the invention wherein the entire incoming stream is fed in liquefied form to sustain just one refrigerative load and the entire return stream formed is adiabatically compressed so as to attain a temperature close to the temperature of the incoming stream before its expansion in the liquefaction stage and then the return stream is fed directly into a compressor.

A gaseous fluid, which is helium in the case under consideration, is compressed in a compressor I (FIG. 1) at ambient temperature and fed in the form of an incoming stream "a" in the direction indicated by arrow A. On entering a first cooling stage 2 comprising heat exchangers 3, 4 and an expander 5, the stream "a" is cooled in the heat exchanger 3 with a return stream "b" of the same fluid flowing in the direction indicated by arrow B and then the stream "a" is split into a main incoming stream "c", flowing as indicated by arrow C, and a subsidiary incoming stream "d" indicated by arrow D. The stream "d" is expanded in the expander 5, with some external work being done, to a pressure which is between 67 and 50% of the original one. In response to the expansion, the absolute temperature of the stream "d" drops by anywhere between 10° and 20° K., and cooled to the same temperature in the heat exchanger 4 is the main stream "c". The term "incoming" will be omitted from further references to the main and subsidiary streams for the sake of conciseness.

Thus, the compressed gaseous fluid is cooled to a certain temperature in the first cooling stage 2, and at the same time some losses of energy due to irreversibility of the process—e.g., those incurred in the course of heat exchange taking place in the heat exchangers 3 and 4 where the difference between the temperatures of the streams amounts to several degrees, coming around 5° K. in this stage—are compensated for by expanding the subsidiary stream "d" in an expander doing external work. The compressed stream "c" is cooled and losses are compensated for in the heat exchanger 4 due to the fact that the mass of the stream "b" exceeds that of the stream "c".

After that, the stream "c" and the stream "d" are introduced into the next, a second, cooling stage 6, comprising the same items of equipment, i.e., heat exchangers 7, 8 and an expander 9. The stream "c" is fed into the heat exchangers wherein it is cooled by the return stream "b". Also cooled in the heat exchanger 7 is the stream "d" which is then expanded in the expander 9 to an intermediate pressure which makes for the cooling thereof to the temperature of the stream "c" at the outlet from the heat exchanger 8.

In a third cooling stage 10 comprising heat exchangers 11, 12 and an expander 13, the main stream "c" is cooled in the heat exchangers 11 and 12 whereas the stream "d" is cooled in the heat exchanger 11 and expanded in the expander 13 to a pressure close to that at the inlet into the compressor 1 with the result that the temperature of the stream "d" is reduced. Next, the stream "d" is merged with the return stream "e" flowing from a liquefaction stage 14 in the direction indicated by arrow E, and the resultant stream "b" is fed in the direction indicated by arrow B.

On leaving the third stage 10, the main stream "c" is introduced into the liquefaction stage 14 comprising a heat exchanger 15, an expander 16 and a cold compressor 17. On being cooled in the heat exchanger 15 with the return stream "e", the main stream "c" is expanded with liquefaction in the expander 16 and the liquefied fluid is fed to sustain a refrigerative load 18, evaporating as a consequence. The vapour leaving the refrigerative load 18 is adiabatically compressed in the cold compressor 17 so that the temperature thereof rises close to the temperature of the main stream "c" before the expansion thereof in the expander 16 of the liquefaction stage 14. The return stream "e" outflowing from the cold compressor 17 is passed through the heat exchanger 15 and, on being merged with the expanded stream "d", forms the stream "b" which flows through the heat exchangers 12, 11, 8, 7, 4, 3 and is admitted into the compressor I. This completes the cycle which is then repeated.

The above will now be explained by way of an example.

EXAMPLE 1

Helium is compressed in the compressor 1 so that its pressure rises from the atmospheric to 25 bars, forming the incoming stream "a". The compressed helium is cooled in the heat exchanger 3 of the first cooling stage 2 from a temperature of 300° K. to 160° K., and is split into the main stream "c" and the subsidiary one "d". The stream "c", constituting 70% of the stream "a", is cooled in the heat exchanger 4 to a temperature of 150° K., using the return stream "b", while the stream "d" is expanded to a pressure of 18 bars in the expander 5 with the result that the temperature thereof is also 150° K.

In the second cooling stage 6, the main stream "c" is cooled to a temperature of 50° K. by being passed through the heat exchangers 7 and 8 whereas the temperature of the stream "d" is also lowered to 50° K. by expanding this stream in the expander 9 to a pressure of 9.2 bars on cooling same in the heat exchanger 7.

In the third cooling stage 10, the main stream "c" is cooled to a temperature of 14.8° K. by being passed through the heat exchangers 11 and 12, and the subsidiary stream "d" is cooled in the heat exchanger 11 and expanded in the expander 13 to the pressure of the return stream "e", attaining a temperature of 14.5° K. Next, the stream "d" is merged with the stream "e", forming the return stream "b", whereas the main stream "c" outflowing from the third cooling stage 10 is admitted into the liquefaction stage 14 comprising the heat exchanger 15, the expander 16 and the cold compressor 17.

In the liquefaction stage 14, the main stream "c" of compressed helium is cooled in the heat exchanger 15 to a temperature of 5.9° K. and expanded in the expander 16 to a pressure of 0.42 bar, transforming into liquid helium. The liquefied stream "c" is fed to sustain the refrigerative load 18 and evaporates in consequence, removing heat from the load. Since the pressure in the refrigerative load is 0.42 bar, the corresponding temperature is 3.4° K., and the vapour of helium constituting the return stream "e" is admitted at this temperature into the cold compressor 17 for compression therein. After the compression, the temperature of the stream "e" is 5.75° K. and the pressure, 1.3 bar which assures the passage of the return stream "e" and, at a latter stage, of the return stream "b" through the heat exchangers 15, 12, 11, 8, 7, 4 and 3. As the stream "e" is warmed up in the heat exchanger 15, it is merged with the expanded stream "d", both streams having the same pressure and temperature, and the stream "b" so formed is warmed up tp 295° K. in the heat exchangers 12, 11, 8, 7, 4 and 3 before being admitted into the compressor 1. This completes the cycle which is then repeated.

Inasmuch as the energy consumed in compressing helium in the cold compressor 17 at an average temperature of 4.5° K. is very small, the energy balance remains practically unaffected, making it feasible to lower the level of the refrigeration obtained from 4.5° to 3.4° K. without a rise in the power requirements. A result like this is witnessed mainly due to the fact that the process taking place in the liquefaction stage 14 follows a line approximating the Carnot cycle, i.e., proceeds at minimum losses due to irreversibility, this being one of the advantages offered by the invention disclosed.

The suction pressure of the cold compressor 17 compressing fluid to a pressure of 1.3 bar at a temperature close to 5.9° K. varies with the number of compressing stages and the efficiency of the cold compressor 17. This factor is of importance because the suction pressure controls the temperature evaporating whereat is liquefied fluid. So, if the suction pressure is 0.42 bar, the regrigeration obtained has a temperature of 3.4° K.; a pressure of 0.25 bar lowers the temperature to 3° K. and so on. If the temperature level of the refrigeration obtained is 4.5° K., the pressure of the stream "e" at the outlet from the cold compressor 17 is 2.2 bars and the pressure of the stream "b" at the inlet into the compressor I is 1.9 bar instead of 1 bar as this is the case in the known methods. Thanks to that, the losses of energy are reduced by a good deal. Furthermore, an increase in the pressure of the return stream provides for a significant reduction of the size of the heat-exchanging equipment used to carry the invention disclosed into practice.

Consider another way of carrying the invention into practice wherein the return stream formed from the main stream is compressed in a vacuum pump at ambient temperature before being admitted into the compressor. The disclosed method of obtaining refrigeration in cryogenic systems according to the invention is realized in this case as follows.

Figure 2:
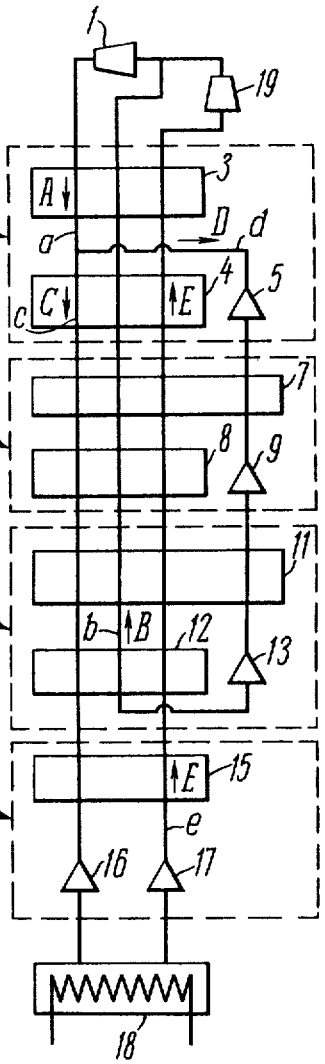
FIG. 2 is a view similar to FIG. 1 illustrating a system wherein the return stream compressed in a cold compressor is formed from the incoming stream and is subject to a preliminary compression to the atmospheric pressure in a vacuum pump before being admitted into the compressor.

A gaseous fluid, e.g., helium, is compressed in a compressor 1 (FIG. 2) so that its pressure rises from the atmospheric to 25 bars and is fed in the form of an incoming stream "a" as indicated by arrow A. This stream is then split, as indicated above, into a main stream "c" directed as indicated by arrow C and a subsidiary stream "d" flowing as shown by arrow D. The stream "a" is cooled by a heat exchange with return streams "b" and "e" the flow whereof is indicated by arrow B and E, respectively. The subsidiary stream "d" is expanded in expanders 5, 9 and 13 incorporated into cooling stages 2, 6 and 10, respectively. The cooling of the streams "c" and "d" is effected in these stages in the same way as described in the foregoing example. The stream "d" expanded to a pressure around 1.25 bar forms in the case under consideration a separate return stream "b" after the expander 13, whereas the main stream "c" expanded in the expander 16 of the liquefaction stage 14 forms, on sustaining the refrigerative load, the stream "e" which is adiabatically compressed in the cold compressor 17. Since the stream "e" is under a pressure which is lower than the pressure of the stream "b", it is given an additional compression to the atmospheric pressure in a vacuum pump 19 on passing through the heat exchangers 15, 12, 11, 8, 7, 4 and 3, being then merged with the stream "b" and both these streams are finally introduced into the compressor 1. This completes the cycle.

The above will now be explained by another example.

EXAMPLE 2

Gaseous helium is compressed in the compressor 1 (FIG. 2) to a pressure of 25 bars, forming thus the incoming stream "a" next split into the main stream "c" and the subsidiary one "d". The stream "d" is expanded and the streams "c" as well as "d" are cooled in the same way as this was described in the preceeding example. The main stream "c" of compressed helium cooled to a temperature around 15° K. in the cooling stages 2, 6 and 10, receives a further cooling to 5.9° K. in the heat exchanger 15 of the liquefaction stage 14 and is then expanded in the expander 16 to a pressure of 0.1 bar, liquefying as a consequence. Liqued helium evaporates in the refrigerative load 18 under a pressure of 0.1 bar and at the temperature of 2.5° K. corresponding to this pressure, and helium vapour leaving the refrigerative load 18 forms the return stream "e" which is adiabatically compressed in the cold compressor 17 to a pressure of 0.55 bar. The temperature of the helium stream "e" increases due to this compression from 2.5 to 5.75° K., i.e., approaches the temperature of the stream "c" of compressed helium before the expansion thereof in the expander 16. On being compressed in the cold compressor 17, the return stream "e" of helium is warmed up in the heat exchangers 15, 12, 11, 8, 7, 4 and 3 to a temperature of 290° K. which is close to the ambient one. After that, the stream "e" is compressed in the vacuum pump 19 so that its pressure increases from 0.4 bar to the atmospheric, merged with the stream "b" and fed into the compressor 1 for compression. This completes the cycle.

Improved economy of the disclosed method of obtaining refrigeration—when this method is being realized as indicated above—results, on one hand, from carrying out the process in the liquefaction stage—as indicated in the preceeding example—under the conditions approximating those of the Carnot cycle, i.e., at a minimum of irreversible losses, and, on the other hand, due to a considerable reduction of the power requirements for obtaining refrigeration at the level of 2.5° K. compared with the known methods as this is illustrated by this example. In fact, the lack of the compression of helium vapour in the vacuum pump 19 at low-temperature level results in an almost five-fold increase of the compression ratio, entailing not only a substantial rise in power requirements but also the enlarging of the pump 19 by a good deal. Since in the method disclosed the heat exchangers operate under a pressure of 0.5 bar, compared with 0.07 bar in the known methods, their size can be reduced to a fraction of the size of the heat exchangers used in conjunction with the known methods and the construction simplified in an appreciable way.

The disclosed method of obtaining refrigeration in cryogenic systems, when realized as follows, provides for feeding liquefied fluied to sustain more than one refrigerative load, one whereof being sustained at a temperature below the boiling point of the fluid corresponding to the pressure whereat the load is sustained. To cope with the situation, additional cooling of the fluid before feeding same to sustain the refrigerative load is effected in another refrigerative load by the heat exchange between the liquefied main stream and a portion thereof split therefrom and boiling under a reduced pressure corresponding to the temperature cooled whereto is the main stream. Said reduction in the temperature boiling whereat is the split stream results from the adiabatic compression of the vapour which is formed in sustaining another refrigerative load and joins the main stream eventually.

Figure 3:
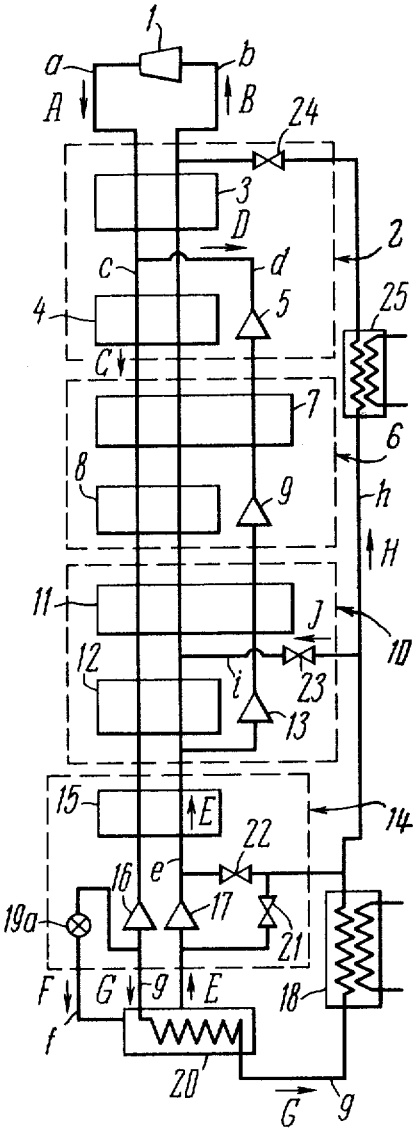
FIG. 3 is a view similar to FIG. 2 illustrating a system in accordance with the invention wherein sustained are two refrigerative loads in the first whereof the incoming stream is cooled by evaporating a portion of same under low pressure and the vapour so formed is adiabatically compressed so as to attain a temperature close to the temperature of the incoming stream before the expansion thereof in the liquefaction stage.

This way of realizing the disclosed method of obtaining refrigeration in cryogenic systems according to the present invention is illustrated in FIG. 3 and carried into practice as follows.

Gaseous fluid, e.g., helium, is compressed in a compressor 1 (FIG. 3) and fed in the form of an incoming stream "a" in the direction indicated by arrow A. In a first stage 2, this stream is cooled in a heat exchanger 3 by a return stream "b", the flow whereof is shown by arrow B, and split into a main stream "c" and a subsidiary one "d" flowing as indicated by arrows C and D, respectively. The subsidiary stream "d" is expanded in expanders 5, 9 and 13 of cooling stages 2, 6 and 10, respectively. The cooling of the streams "c" and "d" is effected exactly in the same way as described hereinabove. The cooled outflow of the main stream from the third cooling stage 10 is introduced into a liquefaction stage 14 comprising a heat exchanger 15, an expander 16, a valve **19*a* and a cold compressor 17. On being cooled in the heat exchanger 15 of the liquefaction stage 14, the main stream "c" is expanded in the expander 16 to a pressure close to the pressure sustained whereat is a refrigerative load 18. The temperature of the stream "c" is limited by the pressure of the return stream "e" and is above the specified level of refrigeration, this being below the boiling point of the fluid under the atmospheric pressure. A further lowering of the temperature of the stream of fluid before sustaining the refrigerative load 18 achieved through the use of another refrigerative load 20**, proceeding as follows.

A stream "f", flowing as indicated by arrow F, is split from the main stream "c" after the expansion thereof in the expander 16, expanded through the valve **19*a* and fed to sustain another refrigerative load 20 where it is brought to the boil under a pressure bellow that of the return stream "e". A stream "g" formed after the separation of the stream "f" flows as indicated by arrow G into another refrigerative load 20 where it is cooled to the requisite temperature due to the heat exchange with the stream "f" and fed to sustain the refrigerative load 18, whereas the stream "f" evaporates and forms the stream "e". The temperature of the stream "f" is reduced by compressing adiabatically the vapour of the stream "f" displaying a reduced pressure in the cold compressor 17. The result is that the stream "g" is admitted into the refrigerative load 18** under specified pressure and at specified temperature, providing thus for sustaining this refrigerative load—a superconductive device by way of illustration—under specified conditions.

On evaporating in the refrigerative load 18, the stream "g" may leave same, depending on the kind of the load, either at a temperature close to that of the stream "e" downstream of another refrigerative load 20, being then merged with the return stream "e" by way of a valve 21, or at a temperature equal to that of the stream "e" downstream of the cold compressor 17, being merged in case with the return stream through a valve 22. If the temperature of the stream "g" downstream of the refrigerative load 18 exceeds that of the stream "d" downstream of the expander 13, this stream is merged with the return stream "b" by means of valves 23 or 24 depending on the temperature.

Not excluded is the need to sustain further refrigerative loads 25, which can be the terminals of the superconductive device, by warming up the stream "g" or part thereof to ambient temperature. As it will be noted from FIG. 3, the stream "g" leaving the refrigerative load 18 is split into two streams, a stream "i" flowing as indicated by arrow I and a stream "h" flowing in the direction indicated by arrow H. The stream "i" is merged with the return stream "b" downstream of the heat exchanger 12, and the stream "h" is warmed up in the further refrigerative load 25, attaining a temperature close to the ambient one, before being merged with the return stream "b" fed into the compressor I. With the admission of the return stream "b" into the compressor I the cycle is completed.

The above will now be explained by a further example.

EXAMPLE 3

Helium is compressed in the compressor I (FIG. 3) to a pressure of 30 bars, forming the incoming stream "a". This stream is cooled to a temperature of 100° K. with the return stream "b", both streams passing through the heat exchanger 3 of the first cooling stage 2, and split into the main stream "c" and the subsidiary one "d". Constituting around 15% of the stream "a", the stream "c" is cooled to a temperature of 95° K. with the return stream "b" in the heat exchanger 4 whereas the stream "d" is expanded to a pressure of 20 bar in the expander 5, its temperature downstream of the expander 5 being also close to 95° K. In the second cooling stage 6, the main stream "c" of helium is cooled to a temperature of 30° K. by being passed through the heat exchangers 7 and 8, and the stream "d" is cooled in the heat exchanger 7 and expanded in the expander 9 to a pressure of 12 bars so that the temperature of this stream is also almost 30° K. In the third cooling stage 10, the main stream "c" is cooled to a temperature of 5.9° K. by being passed through the heat exchangers 11, 12, and the subsidiary stream "d" cooled in the heat exchanger 11 is expanded to a pressure of the return stream "e" in the expander 13 and merged with the stream "e", forming thus the return stream "b". The temperature of the stream "d" downstream of the expander 13 is 5.75° K.

The outflow of the main stream "c" leaving the third cooling stage 10 is admitted into the liquefaction stage 14. Since the temperature at the outlet from the cooling stage 10 is equal to the initial temperature whereat the stream "c" is expanded in the expander 16 of the liquefaction stage 14, the heat exchanger 14 is inoperative in the case under consideration. The main stream "c" is expanded in the expander 16 of the liquefaction stage 14 to a pressure of 2.5 bars and liquefies in consequence, having a temperature of 4.6° K. A portion of this stream, constituting the stream "g", is fed into another refrigerative load 20 wherein it is cooled from 4.6° to 3.5° K. due to the evaporation of the stream "f" which is expanded through the valve **19*a* to a pressure of 0.42 bar whereat the boiling point is 3.4° K. The vapour of helium constituting the return stream "e" is introduced into the cold compressor 17 which compresses the stream to a pressure of 1.3 bar, enabling the return stream "e" to pass through the heat exchangers 15, 12, 11, 8, 7, 4 and 3**.

In the example under consideration, the stream "g" of helium under a pressure of 2.5 bars and at a temperature of 3.5° K. is fed to sustain the refrigerative load 18 wherein its pressure lowers to 1.25 bar and the temperature rises to 20° K. due to heat exchange. The stream "g" leaving the refrigerative load 18 is split into the stream "i" which constitutes 85% of the stream "g" and is merged with the return stream "b" by way of the valve 23 as well as into the stream "h" which is warmed up to 300° K. in sustaining the further refrigerative load 25 and merged with the stream "b" through the valve 24.

Thus, it becomes evident that the cold compressor 17 provides for feeding liquefied liquid under a pressure of 2.5 bars and at a temperature of 3.5° K. to sustain the refrigerative load 18 without using a vacuum pump before the compressor I and under conditions when the power requirements are at their minimum.

Figure 4:
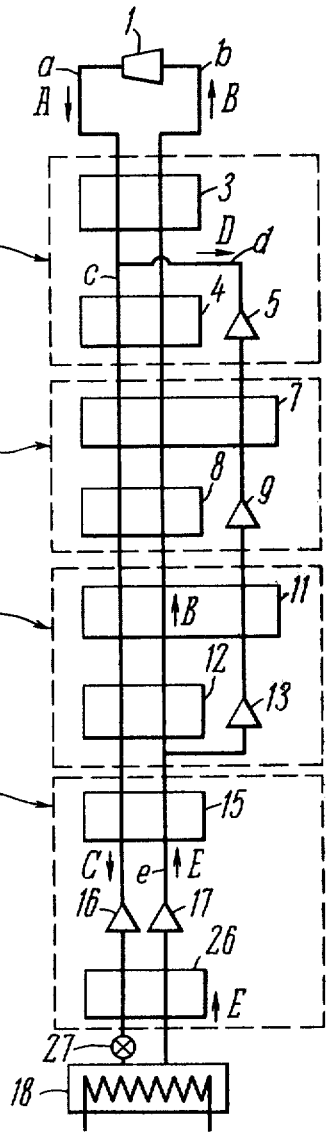
FIG. 4 is a view similar to FIG. 3 illustrating a system wherein the return stream is warmed up by the expanded incoming stream before being adiabatically compressed.

Another embodiment of the disclosed method of obtaining refrigeration at cryogenic level can be realized as illustrated in FIG. 4.

Gaseous fluid, e.g., helium, is compressed in a compressor I at ambient temperature and fed in the form of an incoming stream "a" as indicated by arrow A. For cooling the compressed fluid in cooling stages 2, 6, 10 and for splitting the stream "a" into a main stream "c" and a subsidiary one "d" the procedure is the same as in the above examples. The stream "c" cooled in the cooling stages 2, 6 and 10 as well as in a heat exchanger 15 of a liquefaction stage 14, is expanded with liquefaction in an expander 16 and fed into a heat exchanger 26 wherein a further cooling takes place. The cooled stream "d" is expanded through a valve 27 and is fed in liquefied form to sustain a refrigerative load 18, evaporating in consequence and forming a return stream "e". This stream is warmed up in the heat exchanger 26, removing therein heat from the expanded main stream "c", adiabatically compressed in a cold compressor 17 and then is warmed up in the successively arranged heat exchangers 15, 12, 11, 8, 7, 4 and 3 before being admitted into the compressor 1 for compression. This completes the cycle.

The above will now be explained by yet another example.

EXAMPLE 4

Gaseous helium is compressed to a pressure of 25 bars in the compressor I, forming the incoming stream "a" which is split into the main stream "c" and the subsidiary one "d" on passing through the heat exchanger 3 of the first cooling stage 2. The subsidiary stream "d" is expanded in the expanders 5, 9 and 13 of the cooling stages 2, 6 and 10, and the cooling of the stream "c" and "d" is accomplished in the same way as in Eamples 1 through 3. In the cooling stages 2, 6 and 10, the main stream "c" of compressed helium is cooled to a temperature around 15° K. and then it is further cooled to 7° K. by being passed through the heat exchanger 15 of the liquefaction stage 14. In the expander 16, the stream is expanded to a pressure of 2.5 bars with the result that its temperature drops to 5° K. In the heat exchanger 26, the stream "c" is cooled with the return stream "e" to 3.6° K., and then the stream "d" is expanded through the valve 27 to a pressure of 0.42 bar whereat its temperature lowers to 3.4° K. Liquefied helium is fed to sustain the refrigerative load 18, evaporates as a consequence and forms the return stream "e" which is warmed up to 4.7° K. with the expanded main stream "c" is the heat exchanger 26 and admitted into the cold compressor 17 for adiabatic compression to a pressure of 1.2 bar which causes an increase in the temperature of the stream "e" to 6.85° K. Next, the stream "e" is passed through the heat exchanger 15 and merged with the expanded stream "d", forming the stream "b". This stream is warmed up to a temperature of 295° K. in the heat exchangers 12, 11, 8, 7, 4 and 3 before being admitted into the suction line of the compressor I. The cycle is completed.

Figure 5:
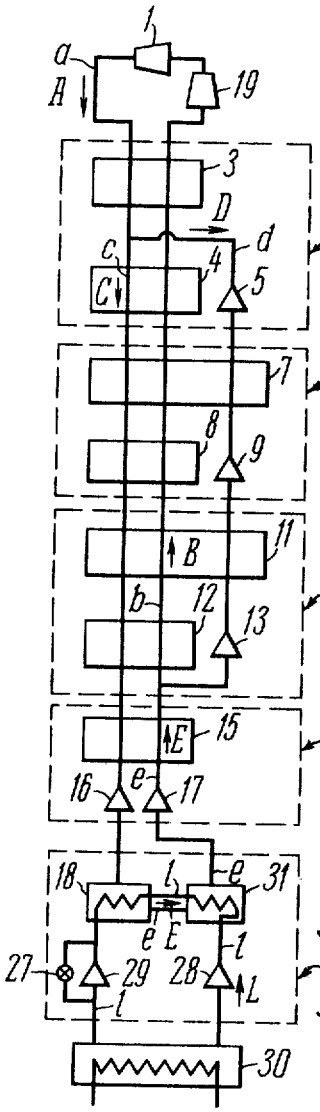
FIG. 5 is a view similar to FIG. 4 illustrating a system sustained wherein are two succissively arranged refrigerative loads circulating in each of which is a separate stream of gaseous fluid, and the return stream outflowing from the preceeding refrigerative load is warmed up by the compressed return stream outflowing from the succeeding refrigerative load before being adiabatically compressed.

A further embodiment of the disclosed method of obtaining refrigeration in cryogenic systems wherein use is made of two successively arranged refrigerative loads flowing through each whereof is a separate stream of gaseous fluid can be carried into practice as illustrated in FIG. 5.

In this case, the return stream outflowing from a preceeding refrigerative load is subject, before being adiabatically compressed, to heat exchange with the return stream outflowing from a succeeding refrigerative load after its adiabatic compression, and the fluid constituting one and another separate stream is helium-4 and helium-3, respectively, which are isotopes of helium.

Referring to FIG. 5, gaseous fluid is compressed in a compressor I, forming an incoming stream "a". After cooling with a return stream "b" in a heat exchanger 3 of a first cooling stage 2, the stream "a" is split into a main stream "c" and a subsidiary one "d". This latter stream is subject to expansion in expanders 5, 9 and 13 of cooling stages 2, 6, 10, and the cooling of the streams "c" and "d" is effected in these stages exactly in the same way as in Examples 1 through 3. The outflow of the stream "c" from the last cooling stage is admitted into a liquefaction stage 14 where it is cooled in a heat exchanger 15 and expanded with liquefaction in an expander 16. The liquefied stream "c" is fed to sustain a preceeding refrigerative load 18, evaporating as a consequence, and the vapour constitutes a return stream "e", flowing in the direction of arrow E, which is warmed up in a heat exchanger 31 and compressed in a cold compressor 17. Downstream of the cold compressor 17 and the heat exchanger 15, the stream "e" is merged with the expanded stream "d". The resultant return stream "b" is passed through the heat exchangers 12, 11, 8, 7, 4 and 3 where it is warmed up to a temperature close to the ambient before being admitted into the compressor I wherefrom it emerges as the incoming stream "a". If the pressure of the stream "b" at the outlet from the cooling stage 2 is below the atmospheric due to the conditions of operation, it is precompressed in a vacuum pump 19 so that the pressure is equal to the atmospheric.

The stream "c" of liquefied fluid is evaporated in the preceeding refrigerative load 18 and the stream "e" is warmed up in the heat exchanger 31 due to the cooling and liquefaction of a separate stream "1" of, for example, helium-3 which is an isotope of helium. Flowing in the direction indicated by arrow L, the stream "1" circulates only within the boundaries of a stage 32 comprising, along with the refrigerative load, the heat exchanger 21, a cold compressor 28 and a means of expansion 27. The outflow of the separate stream "1" from the preceeding refrigerative load 18 is expanded either in the means 27 or in a means 29, which can be of any construction suitable for the purpose they serve, and is fed to the succeeding refrigerative load 30 sustained at a more lower temperature level then the refrigerative load 18. The return stream "1" formed due to the evaporation of liquid fluid in sustaining the succeeding refrigerative load 30 is introduced into the cold compressor 28 wherein it is adiabatically compressed and is again fed into the heat exchanger 31 the outflow wherefrom is introduced into the preceeding refrigerative load 18.

The above way of carrying the invention into practice is explained by the following example which should be read in conjunction with FIG. 5.

EXAMPLE 5

Helium is compressed to a pressure of 25 bars, using the compressor I, and thus forms the incoming stream "a" fed at a temperature of 300° K. into the first cooling stage 2 where it is split into the main stream "c" and the subsidiary one "d" after being passed through the heat exchanger 3. The subsidiary stream "d" is expanded in the expanders 5, 9 and 13 of the cooling stages 2, 6 and 10. The cooling of the streams "c" and "d" in these stages takes place in the same way as in the foregoing Examples 1 through 4. The outflow of the main stream "c" from the third cooling stage 10 is introduced into the liquefaction stage 14 where it is cooled to a temperature of 5.9° K. by being passed through the heat exchanger 15 and is expanded to 0.2 bar with liquefaction in the expander 16. The stream "c" of liquid helium is fed into the preceeding refrigerative load 18, evaporates at a temperature of 2.85° K. and forms the stream "e" which is warmed up to a temperature of 3.6° K. by being passed through the heat exchanger 31 and is compressed in the cold compressor 17 so that its temperature rises to 5.75° K. and the pressure increases to 0.6 bar. After the cold compressor 17, the stream "e" is passed through the heat exchanger 15 and is merged with the stream "d". The resultant stream "b" is passed through the heat exchangers 12, 11, 8, 7, 4 and 3 where it warms up to a temperature of 293° K., is precompressed in the vacuum pump 19 so that the pressure increases from 0.4 to 1.05 bar and is admitted into the compressor I, being again transformed therein into the stream "a".

The stream "c" of liquid helium is evaporated in the preceeding refrigerative load 18 and warmed up in the heat exchanger to the temperature of 3.6° K. due to the cooling and condensation of the separate stream of helium-3, an isotope of helium, taking place under a pressure of 0.82 bar and at a temperature of 3.0° K. The mass of the stream "1" is around 70% of the mass of the stream "c". The stream "1" of helium-3 is expanded through the valve 27 to a pressure of some 0.1 bar while its temperature drops to 1.8° K., and is admitted into the succeeding refrigerative load 30 sustained at the temperature of 1.8° K. On absorbing heat from the load, liquid helium-3 vapourizes and the vapour so formed as adiabatically compressed in the cold compressor 28 to a pressure of 0.85 bar with an accompanying rise in the temperature to 3.8° K., passed through the heat exchanger 31 and admitted into the preceeding refrigerative load 18.

The recourse to helium-3, which is an isotope of helium characterized by a boiling point lower than that of the commonly used helium-4 at given temperature, improves the operating conditions for the cold compressors 17 and 28, reduces the size of the refrigerator sustained wherein at the above low level of temperature is the load 30 and decreases the power requirements for compressing the stream "b" in the vacuum pump 19.

Figure 6:
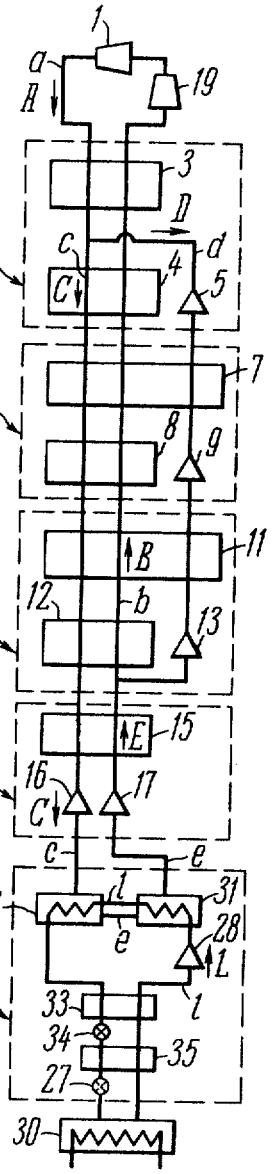
FIG. 6 is a view similar to FIG. 5 illustrating a system wherein the return stream outflowing from the succeeding refrigerative load is warmed up by the incoming stream of the gaseous fluid before being adiabatically compressed.

Yet another embodiment of the disclosed method of obtaining refrigeration in cryogenic system wherein the return stream outflowing from the succeeding refrigerative load is warmed up, before being adiabatically compressed, by the incoming stream of the fluid before its expansion can be carried into practice as indicated in FIG. 6.

A gaseous fluid compressed in a compressor I formes an incoming stream "a". The cooling of the compressor fluid in cooling stages 2, 6, and 10, the splitting of the stream "a" into a main stream "a" and a subsidiary one "d" and the expansion of the stream "d" in expanders 5, 9 and 13 are carried out in the same way as outlined in Examples 1 through 5. The process taking place in a stage 32 is the same as described in Example 5 except that a separate stream "1" is warmed up with the same compressed stream "1" in heat exchangers 33 and 35 before being adiabatically compressed. This is explained by an example which follows.

EXAMPLE 6

Helium compressed to a pressure of 28 bars in the compressor I forms, as described in the preceeding examples, the incoming main stream "c" admitted into the stage 32 from the liquefaction stage 14 at a temperature of 4.4° K. and under a pressure of 1.2 bar. The cooling in the stages 2, 6, 10 and 14 proceeds so that the outflow of the stream "c" from the heat exchanger 15 of the liquefaction stage 14 has a temperature of 12° K. The expansion of this stream in the expander 16 to the pressure of 1.2 bar is accompanied by the liquefaction of around 9% of the stream "c". In the stage 32, the liquefied portion of the stream "c" is evaporated in the preceeding refrigerative load 18 and the resultant return stream "e" is fed into the heat exchanger 31 wherefrom it is returned into the liquefaction stage 14 at a temperature of 11.5° K. and under a pressure of 1.2 bar. In the liquefaction stage 14, the return stream is compressed in the cold compressor 17 so that the pressure and temperature rise to 1.3 bar and 11.75° K., respectively, and is fed into the heat exchanger 15, the rest of operations being accomplished as described in Examples 1 through 5. In the stage 32, the separate stream "1" of helium-3 compressed to a pressure of 2 bars is cooled to 4.5° K. in the heat exchanger 31 and the preceeding refrigerative load 18, cooled again in the heat exchanger 33, expanded through the valve 34 so that its pressure is reduced to 0.8 bar, cooled once more in the heat exchanger 35 and then expanded through the valve 27 to a final pressure of 0.28 bar, the temperature of helium-3 lowering to 2.1° K. at this pressure. Next, the stream "1" is fed to sustain the succeeding refrigerative load 30, evaporates in consequence and forms the return stream "1" outflowing from the succeeding refrigerative load 30 into the heat exchangers 35 and 33. On warming up therein to 4.4° K., the return stream "1" is adiabatically compressed in the cold compressor 28 to a pressure of 2 bars, its temperature consequently increasing to 12° K., and fed again in the heat exchanger 31. This completes the circuit circulating wherethrough is the separate stream "1".

From Example 6, illustrating the way a cryogenic stream can operate, there are good reasons to conclude that a reduction of the temperature difference in the heat exchanger 15 of the liquefaction stage 14 and, consequently, a reduction of the losses due to irreversibility is attainable during the heat transfer between the expanded stream "c" and the compressed separate stream "1" either by adiabatically compressing the return stream "e" or by warming same up. In particular, as this is also evident from Example 6, the losses due to the irreversibility of the process of heat exchange in the liquefaction stage lend themselves to minimization by employing the cold compressor 17 with a compression ratio as low as 1.08.

Figure 7:
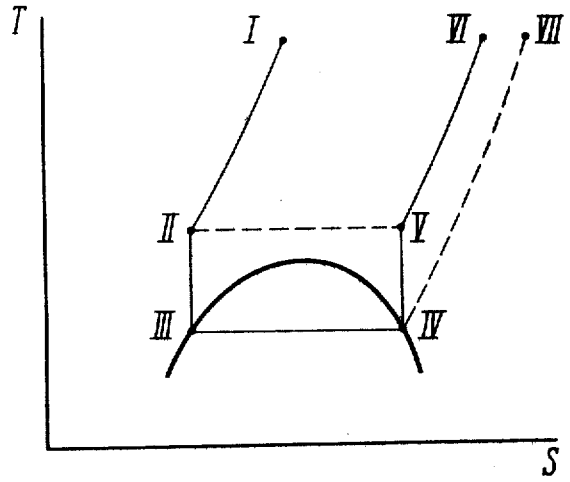
FIG. 7 is a temperature-entropy diagram of the process taking place in the liquefaction stage in accordance with the invention illustrated in FIGS. 1 and 2.

Depicted in FIG. 7 is a temperature-entropy diagram of the process taking place in the liquefaction stage wherein according to the invention the vapour outflowing from the refrigerative load is adiabatically compressed to a temperature close to the temperature beginning whereat is the expansion of the main stream. The cooling of the main stream "c" in the heat exchanger of FIG. 1 will take place in this case along line I-II, the expansion of the compressed stream "c" in the expander 16 will proceed as indicated by line II-III, the way the refrigeration obtained is used to sustain the refrigerative load 18 will be characterized by line III-IV, the adiabatic compression of the vapour outflowing from the refrigerative load 18 will take place according to line IV-V and the stream "e" will be warmed up along line V-VI.

Unlike any of the known methods inherent wherein is an irreversibility of a high order brought about a great difference of the temperatures at points II and IV, the process itself being carried out as indicated by lines I-II-III-IV-VII, beginning whereat is the process of heat exchange in the liquefaction stage lacking a cold compressor, in the method according to the invention the process taking place in the liquefaction stage theoretically follows the pattern of the fully reversible process, as this can be seen from FIG. 7. What allows to capitalize on in realizing the present invention is the fact that in the method disclosed the gaseous fluid is compressed in the compressor I starting from a pressure characterized by point VI which is higher than the pressure characterized by point VII whereat compression is started in the known methods. The gains from reducing the power requirements, as this is the case in the method disclosed, are obvious.

What is claimed is:

1. A method of obtaining refrigeration at cryogenic level comprising compressing a gaseous fluid constituting an incoming stream, stepwise cooling the incoming stream, expanding the incoming stream with its liquefaction, feeding the liquid fluid so formed to sustain at least one refrigerative load wherein the liquid is transformed into vapour constituting a return stream flowing back from the refrigerative load sustained, and adiabatically compressing the return stream flowing back from the refrigerative load so as to attain a temperature close to the temperature of the incoming stream before the expansion thereof with liquefaction; said stepwise cooling of the incoming stream being effected with said return stream.

2. A method of obtaining refrigeration as claimed in claim 1, wherein the return stream is warmed up with the expanded incoming stream before being adiabatically compressed.

3. A method of obtaining refrigeration wherein sustained are at least two successively arranged refrigerative loads flowing through each of which is a separate return stream of gaseous fluid as claimed in claim 1, and wherein the return stream outflowing from a preceeding refrigerative load is subject, before being adiabatically compressed, to a heat exchange with the return stream outflowing from a succeeding refrigerative load after the adiabatic compression thereof.

4. A method of obtaining refrigeration as claimed in claim 3, wherein the return stream outflowing from the succeding refrigerative load is warmed up with the incoming stream of said fluid before being adiabatically compressed.

5. A method of obtaining refrigeration as claimed in claim 3, wherein the gaseous fluid constituting the stream of the succeeding refrigerative load is helium-3, an isotope of helium.

* * * * *